US011699860B1

(12) United States Patent
Scott

(10) Patent No.: US 11,699,860 B1
(45) Date of Patent: Jul. 11, 2023

(54) ANTENNA STRUCTURE FOR SATELLITE-COMMUNICATIONS GATEWAY

(71) Applicant: Hughes Network Systems, LLC, Germantown, MD (US)

(72) Inventor: Michael Scott, Germantown, MD (US)

(73) Assignee: Hughes Network Systems, LLC, Germantown, MD (US)

( * ) Notice: Subject to any disclaimer, the term of this patent is extended or adjusted under 35 U.S.C. 154(b) by 0 days.

(21) Appl. No.: 17/562,594

(22) Filed: Dec. 27, 2021

(51) Int. Cl.
*H01Q 15/16* (2006.01)
*H01Q 19/12* (2006.01)

(52) U.S. Cl.
CPC ..... *H01Q 15/165* (2013.01); *H01Q 19/12* (2013.01)

(58) Field of Classification Search
CPC ..... H01Q 3/08; H01Q 15/14; H01Q 15/141; H01Q 15/142; H01Q 15/16; H01Q 15/162; H01Q 15/165; H01Q 15/166; H01Q 15/168; H01Q 19/10; H01Q 19/12; H01Q 19/18; H01Q 19/19; H01Q 19/193; H01Q 15/161
See application file for complete search history.

(56) References Cited

U.S. PATENT DOCUMENTS 4,710,777 A * 12/1987 Halverson ..... H01Q 15/168 343/912
5,184,145 A * 2/1993 Devillers ..... H01Q 1/1235 343/916
2005/0168852 A1* 8/2005 Rudi ..... H01Q 15/166 359/853
2010/0315306 A1* 12/2010 Strydesky ..... H01Q 15/161 343/840
2014/0152492 A1 6/2014 Zimmerman et al.
2017/0025745 A1* 1/2017 Clayton ..... H01Q 1/1235
2022/0286200 A1* 9/2022 Majeres ..... H01Q 19/19

FOREIGN PATENT DOCUMENTS

CN 105958211 A * 9/2016
CN 107275795 A * 10/2017 ..... H01Q 15/162
CN 208835260 U * 5/2019
CN 208835260 U 5/2019
CN 110137663 A * 8/2019 ..... H01Q 1/12

OTHER PUBLICATIONS

Comtech Space and Component Technology Company Overview and Focus on Antennas and Radomes, Jul. 2021, p. 1-19, retrieved from https://www.comtech-mct.com/products/mct/space-and-component-technology/ground-systems (Year: 2021).*

(Continued)

*Primary Examiner* — AB Salam Alkassim, Jr.
*Assistant Examiner* — Leah Rosenberg
(74) *Attorney, Agent, or Firm* — Bejin Bieneman PLC

(57) ABSTRACT

A satellite-communications gateway includes a hub and an antenna configured for satellite communications. The antenna is mounted to the hub and supported by the hub. The antenna includes a plurality of panels forming a parabolic dish. The panels are carbon fiber-reinforce polymer. The parabolic dish has a diameter in a range of 9 to 13 meters.

17 Claims, 6 Drawing Sheets

(56) References Cited

OTHER PUBLICATIONS

CGC Space: Shaking up the antenna market, Aug. 2016, p. 24-26, retrieved from https://www.satelliteevolutiongroup.com/articles/CGC-Space.pdf (Year: 2016).*
Comtech Space and Component Technology Company Overview and Focus on Antennas and Radomes, Jul. 2021, p. 1-19, retrieved from https:/Avww.comtech-mct.com/products/mct/space-and-component-technology/ground-systems (Year: 2021).*
International Search Report and Written Opinion for related International Application PCT/US2022/051308 dated Apr. 11, 2023 (24 pages).

* cited by examiner

ANTENNA STRUCTURE FOR SATELLITE-COMMUNICATIONS GATEWAY

BACKGROUND

A satellite-communications gateway includes an antenna structure for receiving and sending transmissions to satellites. Types of satellites includes fixed-service satellites and high-throughput satellites. High-throughput satellites communicate using multiple spot beams on the order of hundreds of miles across, aimed at different regions of the earth's surface. A gateway located in the spot beam is able to communicate with the satellite.

DETAILED DESCRIPTION

Figure 1:
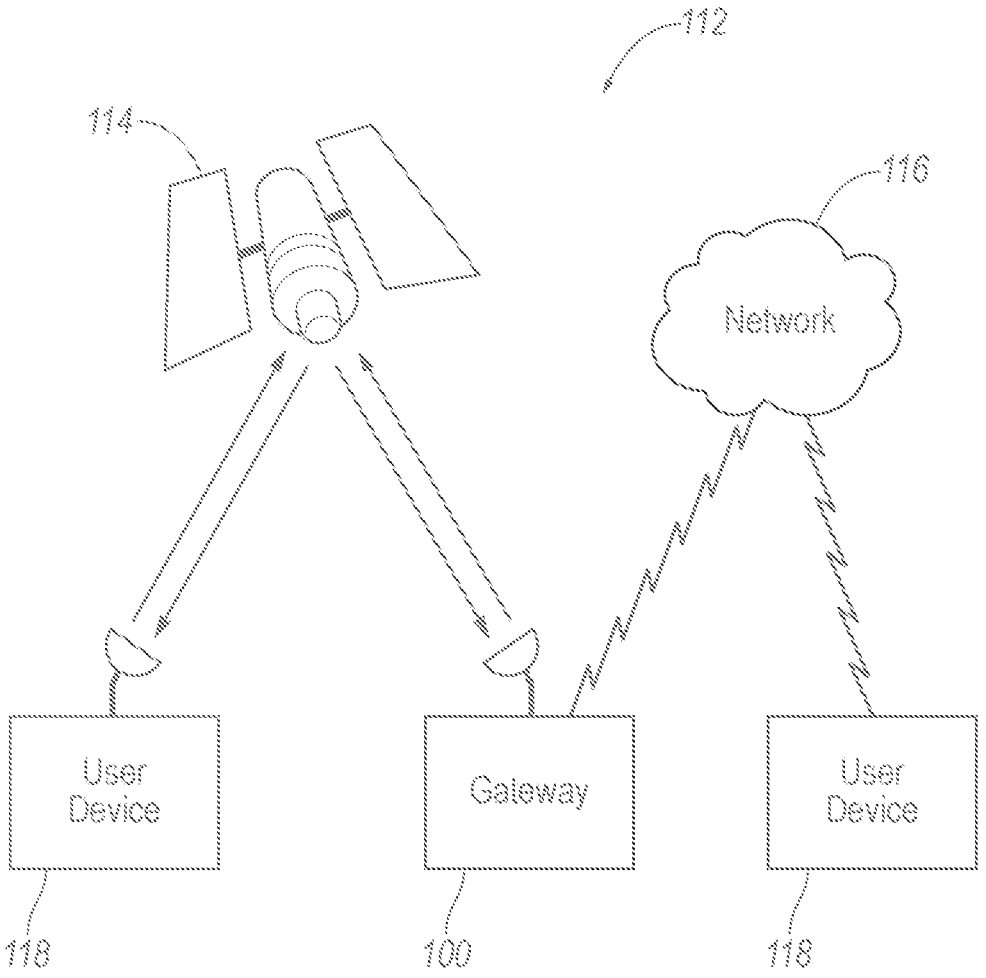
FIG. 1 is a diagram of a satellite-communications system.

A satellite-communications gateway includes a hub and an antenna configured for satellite communications. The antenna is mounted to the hub and supported by the hub. The antenna includes a plurality of panels forming a parabolic dish. The panels are carbon fiber-reinforced polymer. The parabolic dish has a diameter in a range of 9 to 13 meters.

The satellite-communications gateway may further include an electrically conductive mesh affixed to a concave side of the parabolic dish. The mesh may conform to a paraboloid shape defined by the parabolic dish.

The satellite-communications gateway may further include paint covering the mesh and the parabolic dish.

The satellite-communications gateway may further include a plurality of braces attached on a convex side of the parabolic dish, and the braces may be carbon fiber-reinforced polymer. The braces may be elongated in respective radial directions relative to the parabolic dish. Each brace may be elongated in the respective radial direction from the hub to an outer diameter of the parabolic dish.

Each panel may include an inner circumferential edge, an outer circumferential edge, and two radial edges extending between the circumferential edges, and one of the braces may be elongated along each radial edge from the outer circumferential edge toward the inner circumferential edge. Each brace may include two side walls extending away from the respective panel and a cross wall extending between the side walls, the brace may be attached to the respective panel at the side walls, and the cross wall may be spaced from the respective panel. Each cross wall may be angled away from the respective panel in a direction from the outer circumferential edge toward the inner circumferential edge.

Each panel may include a rib extending from the outer circumferential edge toward the inner circumferential edge, and the rib may be positioned within the respective brace.

The panels may include twelve identical panels.

The panels may be arranged in a single series circumferentially about the hub.

The antenna may include a secondary reflector in a Cassegrain configuration with the parabolic dish.

The satellite-communications gateway may further include a pedestal and an actuator assembly movably coupling the hub to the pedestal. The actuator assembly may have two rotational degrees of freedom.

The pedestal may define a vertical axis, and the actuator assembly may include an azimuth bearing assembly that is actuatable to rotate the hub and the antenna about the axis relative to the pedestal.

The actuator assembly may include an elevation jack that is actuatable to tilt the hub and the antenna about a horizontal axis relative to the pedestal. The actuator assembly may include an azimuth bearing assembly, the elevation jack may be mounted to the azimuth bearing assembly, and the azimuth bearing assembly may be actuatable to rotate the hub, the antenna, and the elevation jack about the axis relative to the pedestal.

The pedestal may be fixedly mounted to the ground.

With reference to the Figures, wherein like numerals indicate like parts throughout the several views, a satellite-communications gateway 100 includes a hub 104 and an antenna 106 configured for satellite communications. The antenna 106 is mounted to the hub 104 and supported by the hub 104. The antenna 106 includes a plurality of panels 108 forming a parabolic dish 110. The panels 108 are carbon fiber-reinforced polymer. The parabolic dish 110 has a diameter in a range of 9 to 13 meters.

With reference to FIG. 1, a satellite-communications system 112 can include one or more satellites 114, one or more gateways 100, a network 116, and one or more user devices 118.

The satellites 114 collectively form a constellation (i.e., a group) of network nodes whose position may change relative to one another, to the ground, or both. The satellites 114 include various circuits, chips, or other electronic components. For example, satellites 114 may be in low Earth orbit (LEO) in multiple planes and orbits relative to one another or in a geostationary orbit (GEO). The satellites 114 may be high-throughput satellites that communicate using spot beams.

The satellite-communications system 112 can include multiple gateways 100. Each gateway 100 may be a site for converting the microwave transmissions from the satellites 114 to digital signals that can be sent over the network 116. Each gateway 100 can include an antenna structure 120 for receiving and sending transmissions to the satellites 114, as will be described in more detail below.

The network 116 represents one or more mechanisms by which the gateways 100 may communicate with remote user devices 118. Accordingly, the network 116 may be one or more of various wired or wireless communication mechanisms, including any desired combination of wired (e.g., cable and fiber) and/or wireless (e.g., cellular, wireless, and radio frequency) communication mechanisms and any desired network topology (or topologies when multiple communication mechanisms are utilized). Exemplary communication networks include wireless communication networks (e.g., using Bluetooth, IEEE 802.11, etc.), local area networks (LAN) and/or wide area networks (WAN), including the Internet, providing data communication services.

The user devices 118 are computing devices such as desktop computers, laptop computers, mobile phones such as smartphones, and tablets. The user devices 118 are computing devices generally including a processor and a memory. The user devices 118 may receive and send data to the satellite 114 via the network 116 and the gateway 100, or the user device 118 may be coupled to its own antenna for communicating directly with the satellite 114. The user device 118 may also include an antenna on a mobile platform such as an airplane or train that can send and receive data for devices of passengers on the mobile platform.

Figure 2:
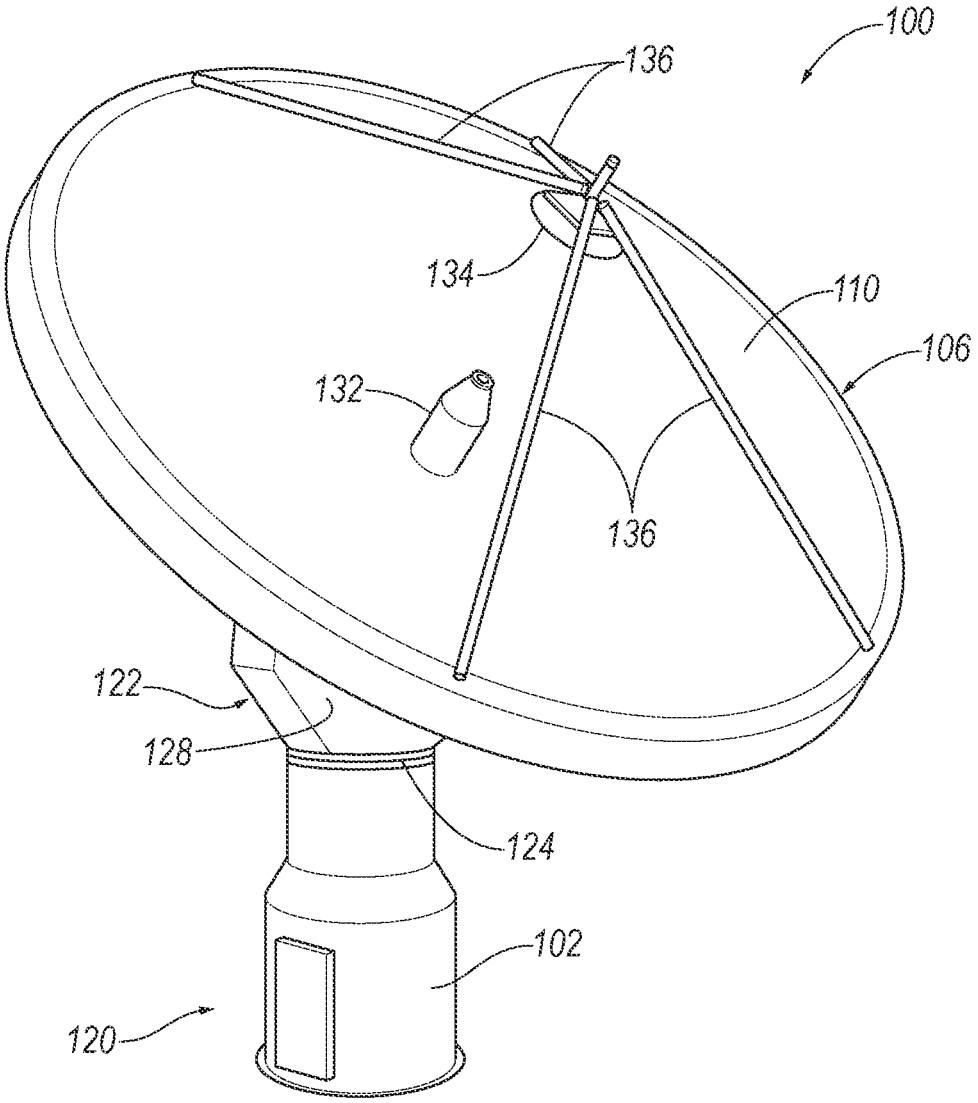
FIG. 2 is a perspective view of an antenna structure of the satellite-communications system at a gateway.
Figure 3:
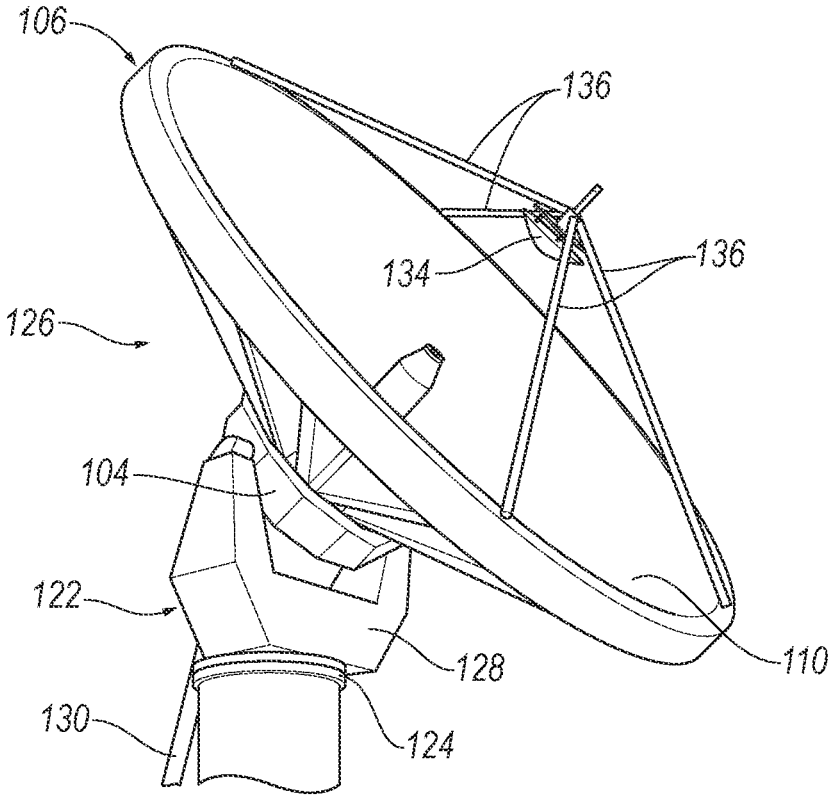
FIG. 3 is a perspective view of a portion of the antenna structure.
Figure 4:
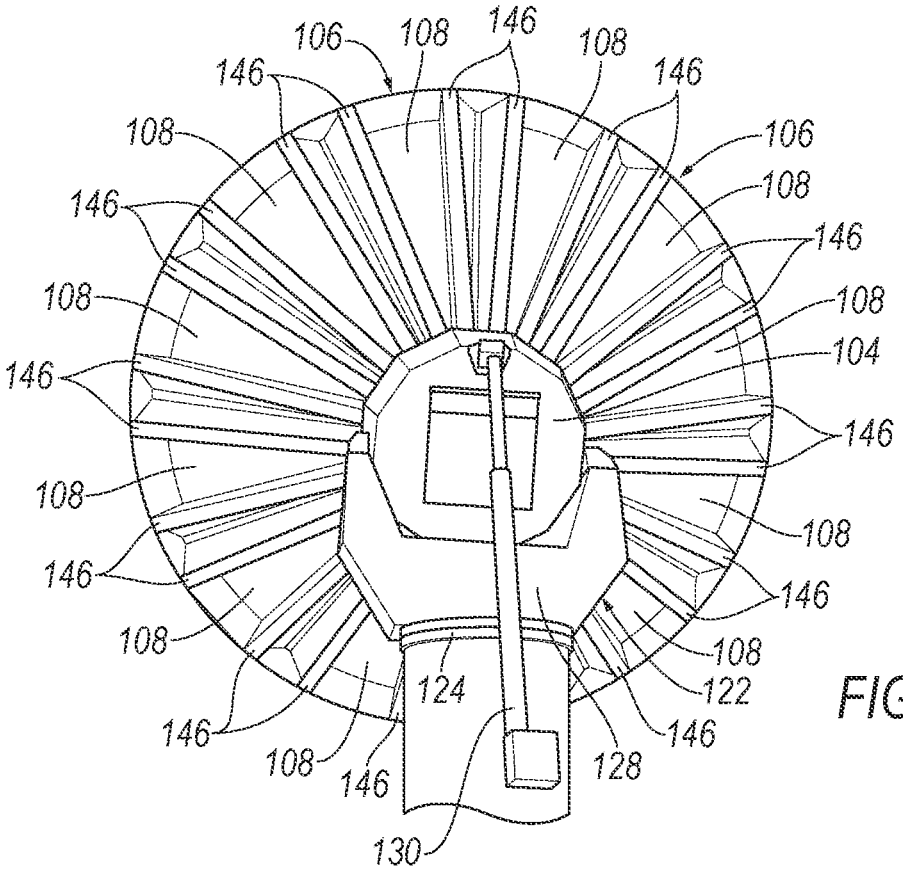
FIG. 4 is a rear perspective view of the portion of the antenna structure.

With reference to FIGS. 2-4, the gateway 100 includes the antenna structure 120. The antenna structure 120 can include a pedestal 102, an actuator assembly 122, the hub 104, and the antenna 106.

With reference to FIG. 2, the pedestal 102 can be fixedly mounted to the ground, e.g., anchored to a concrete platform on the ground. The pedestal 102 does not move relative to the ground. The pedestal 102 can support the other components of the antenna structure 120, e.g., the actuator assembly 122, the hub 104, and the antenna 106, and the other components of the antenna structure 120 can be held above the ground by the pedestal 102. The pedestal 102 can have a generally cylindrical shape that defines a vertical axis. The pedestal 102 can include one or more access doors for maintenance.

With reference to FIGS. 3-4, the actuator assembly 122 movably couples the hub 104 to the pedestal 102. The actuator assembly 122 can have two rotational degrees of freedom, e.g., about the vertical axis defined by the pedestal 102 and about a horizontal axis perpendicular to the vertical axis. In other words, the actuator assembly 122 can control the yaw and pitch of the antenna 106. The actuator assembly 122 can thereby aim the antenna 106 at any point in the sky.

The actuator assembly 122 can include an azimuth bearing assembly 124. The azimuth bearing assembly 124 is actuatable to rotate a top assembly 126 of the antenna structure 120 about the vertical axis relative to the pedestal 102. The top assembly 126 can include the hub 104, the antenna 106, a bracket 128 of the actuator assembly 122, and an elevation jack 130 of the actuator assembly 122. The azimuth bearing assembly 124 rotates the top assembly 126 as a unit, i.e., all together as a single body. The azimuth bearing assembly 124 can include, e.g., a bearing defining the vertical axis and a motor positioned to advance a point of the top assembly 126 along the bearing. The azimuth bearing assembly 124 can also include an encoder to monitor movement of the azimuth bearing assembly 124.

The actuator assembly 122 can include the bracket 128 and the elevation jack 130. The bracket 128 can be mounted on the azimuth bearing assembly 124. The bracket 128 can have a U-shape with two pivot points attached on the sides of the hub 104. The two pivot points can define the horizontal axis. The bracket 128 can be sized to accommodate the hub 104 inside the U-shape of the bracket 128 even when the hub 104 is aimed horizontally. The elevation jack 130 can be mounted to the azimuth bearing assembly 124. For example, the elevation jack 130 can be attached at a point on the bracket 128 and at a point on the hub 104. The elevation jack 130 can be, e.g., a piston that can be actuated to extend or compress. The extension and compression of the elevation jack 130 changes the distance between the attachment points on the hub 104 and the bracket 128, thereby tilting the hub 104 and the antenna 106 about the horizontal axis relative to the bracket 128. The elevation jack 130 can also include an encoder to monitor movement of the elevation jack 130.

The hub 104 is movably coupled to the pedestal 102 via the actuator assembly 122. The hub 104 can have a cylindrical shape or dodecahedral-prism shape defining an antenna axis. The antenna axis defines the direction in which the antenna 106 is aimed, e.g., at one of the satellites 114.

With reference to FIG. 3, the antenna 106 can be configured for satellite communications. For example, the antenna 106 can include the parabolic dish 110 and a feed antenna 132 positioned at the focus defined by the parabolic dish 110. When the antenna 106 is receiving, collimated radio waves, e.g., from a spot beam from one of the satellites 114, reflect off of the parabolic dish 110 and are focused to a point on the feed antenna 132. When the antenna 106 is transmitting, the feed antenna 132 converts a signal to radio waves, which reflect off of the parabolic dish 110 into a parallel beam toward the satellite 114. For another example, as shown in the Figures, the antenna 106 can have a Cassegrain configuration including the parabolic dish 110, the feed antenna 132, and a secondary reflector 134 positioned to reflect radio waves between the parabolic dish 110 and the feed antenna 132. In the Cassegrain configuration, the secondary reflector 134 can be convex toward the parabolic dish 110 and is centered on the antenna axis. In both examples, the parabolic dish 110 has a paraboloid shape centered on the antenna axis. The parabolic dish 110 can be sized for satellite communications, e.g., can have a diameter in a range of 9 to 13 meters. The feed antenna 132 can be centered on the antenna axis.

The antenna 106 can be mounted to the hub 104 and supported by the hub 104 and thereby supported by the pedestal 102. For example, the parabolic dish 110 can be formed of panels 108 that are mounted to the hub 104 and to each other in series around the antenna axis. The secondary reflector 134 can be fixed relative to the parabolic dish 110 by legs 136. The feed antenna 132 can be mounted to the hub 104 at a center of the hub 104. The antenna 106 is fixed relative to the hub 104 and moves with the hub 104 as a rigid body.

Figure 5:
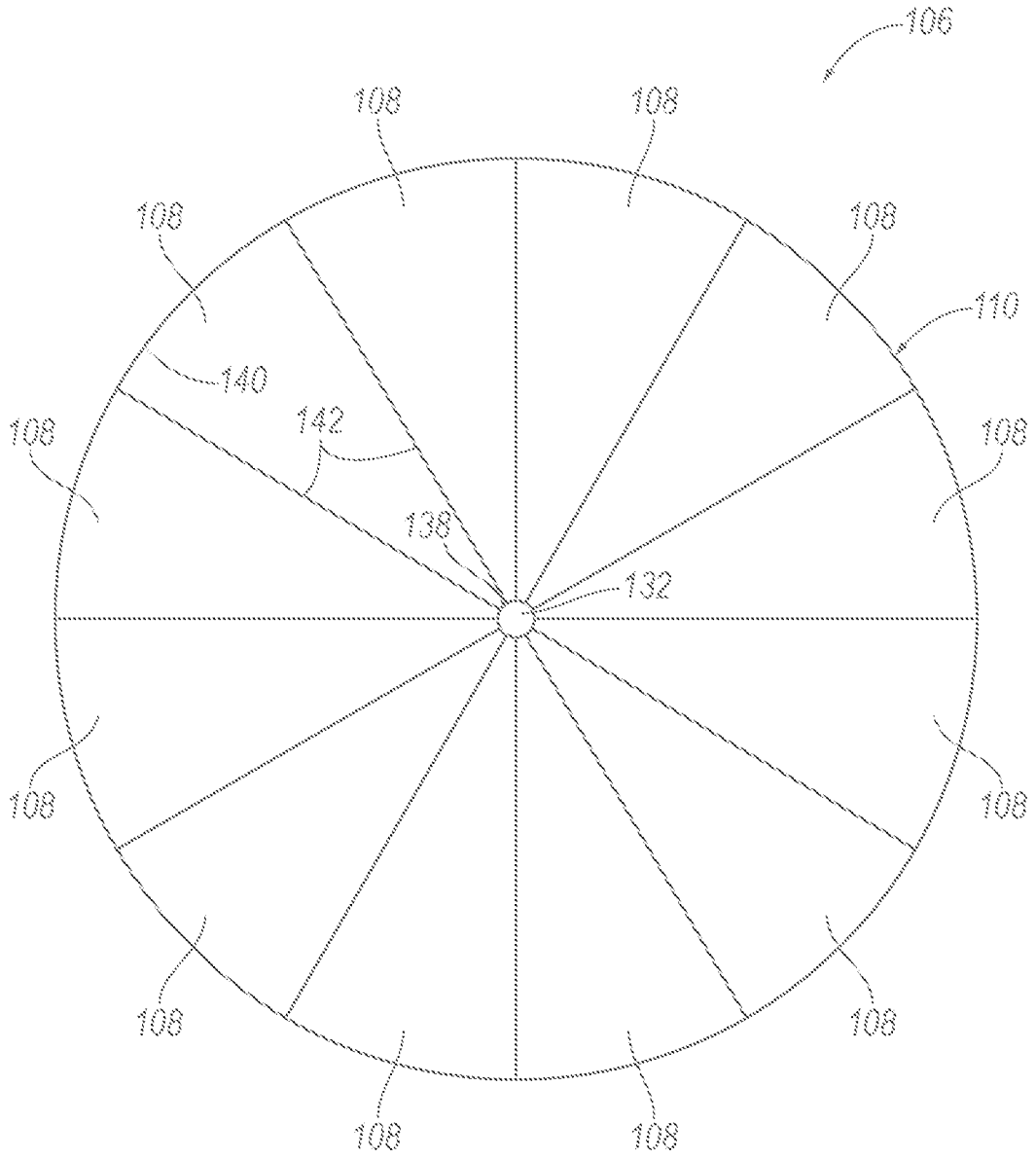
FIG. 5 is a plan view of a parabolic dish of the antenna structure.

With reference to FIG. 5, the antenna 106 includes the plurality of the panels 108. Each panel 108 can include an inner circumferential edge 138, an outer circumferential edge 140, and two radial edges 142 extending between the circumferential edges 138, 140 (for clarity, the edges 138, 140, 142 are labeled for just one of the panels 108 in FIG. 5). The inner circumferential edge 138 and outer circumferential edge 140 can extend circumferentially about the antenna axis. The inner circumferential edge 138 is closer to the antenna axis than the outer circumferential edge 140. The radial edges 142 extend radially outward from the inner circumferential edge 138 to the outer circumferential edge 140. The panel 108 can have a constant thickness (except for ribs 144 discussed below) extending from the inner circumferential edge 138 to the outer circumferential edge 140 and extending from one radial edge 142 to the other radial edge 142, so the panel 108 has the shape of a curved plate. The panels 108 can be identical, i.e., have the same shape as each other.

The panels 108 collectively form the parabolic dish 110. The panels 108 can include, e.g., twelve panels 108, which can make the shape of each panel 108 easier to manufacture within correct tolerances. The panels 108 can be arranged in a single series circumferentially about the hub 104, i.e., about the antenna axis, i.e., in one row extending in a circle about the antenna axis. The panels 108 can be arranged radially symmetrically. The outer circumferential edges 140 can collectively form an outer diameter of the parabolic dish 110. The inner circumferential edges 138 can be positioned radially inside a perimeter of the hub 104. The inner circumferential edges 138 can abut the feed antenna 132. Each panel 108 can be attached to the hub 104 and the two adjacent panels 108. The outer circumferential edges 140 can all be attached together. For example, a ring (not shown) can extend around the outer diameter of the parabolic dish 110, i.e., around the outer circumferential edges 140.

Returning to FIG. 4, the antenna 106 includes a plurality of braces 146. The braces 146 can be positioned to reinforce a rigidity of the parabolic dish 110. The braces 146 can be positioned on a convex side of the parabolic dish 110. The braces 146 can be elongated in respective radial direction relative to the parabolic dish 110, i.e., respective radial directions from the antenna axis. Each brace 146 is elongated from the hub 104 to the outer diameter of the parabolic dish 110, i.e., to the outer circumferential edge 140 of one of the panels 108.

Each brace 146 can be attached on a single one of the panels 108. Each panel 108 can have two braces 146 attached to that panel 108. One of the two braces 146 can be elongated along each radial edge 142 of that panel 108 from the outer circumferential edge 140 toward the inner circumferential edge 138, e.g., to the hub 104. The two braces 146 on each panel 108 can be separate pieces from each other.

Figure 6:
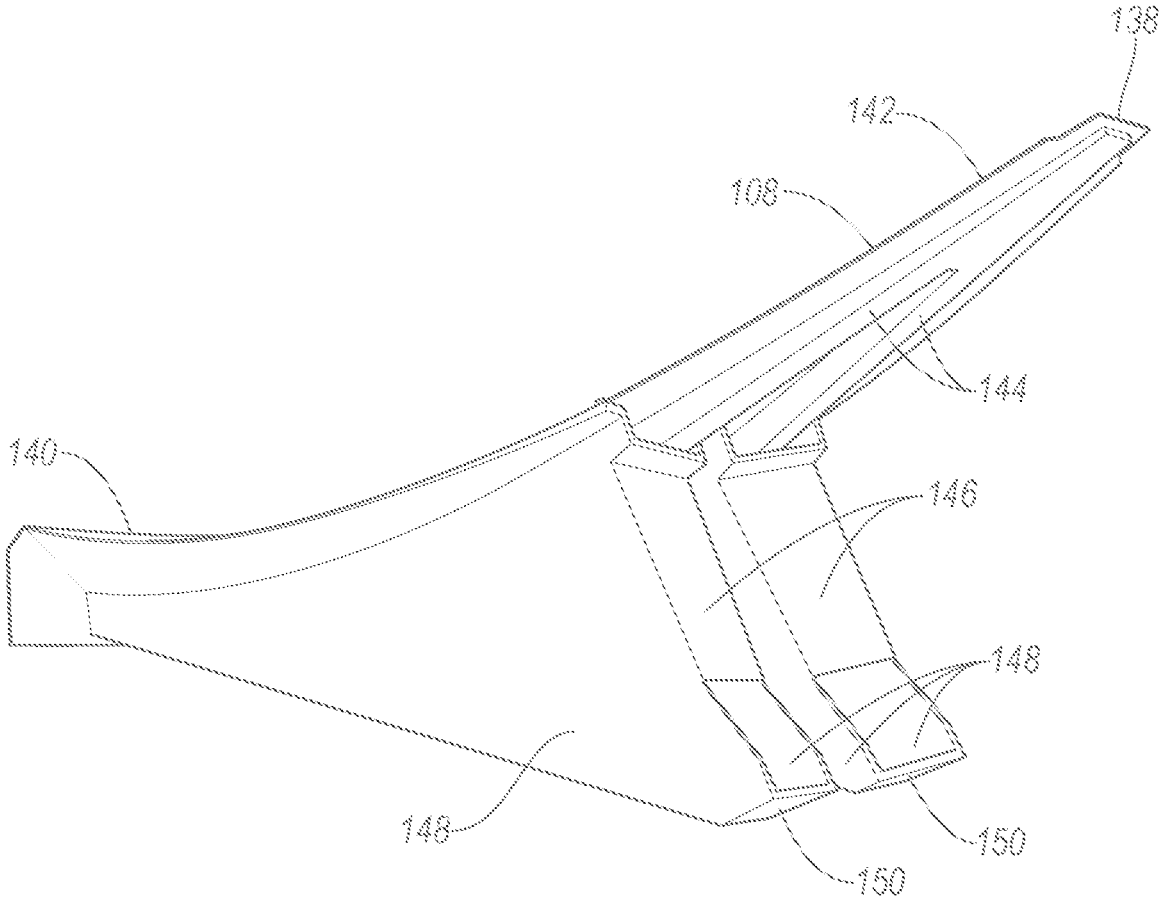
FIG. 6 is a perspective view of a panel and braces of the antenna structure.
Figure 7:
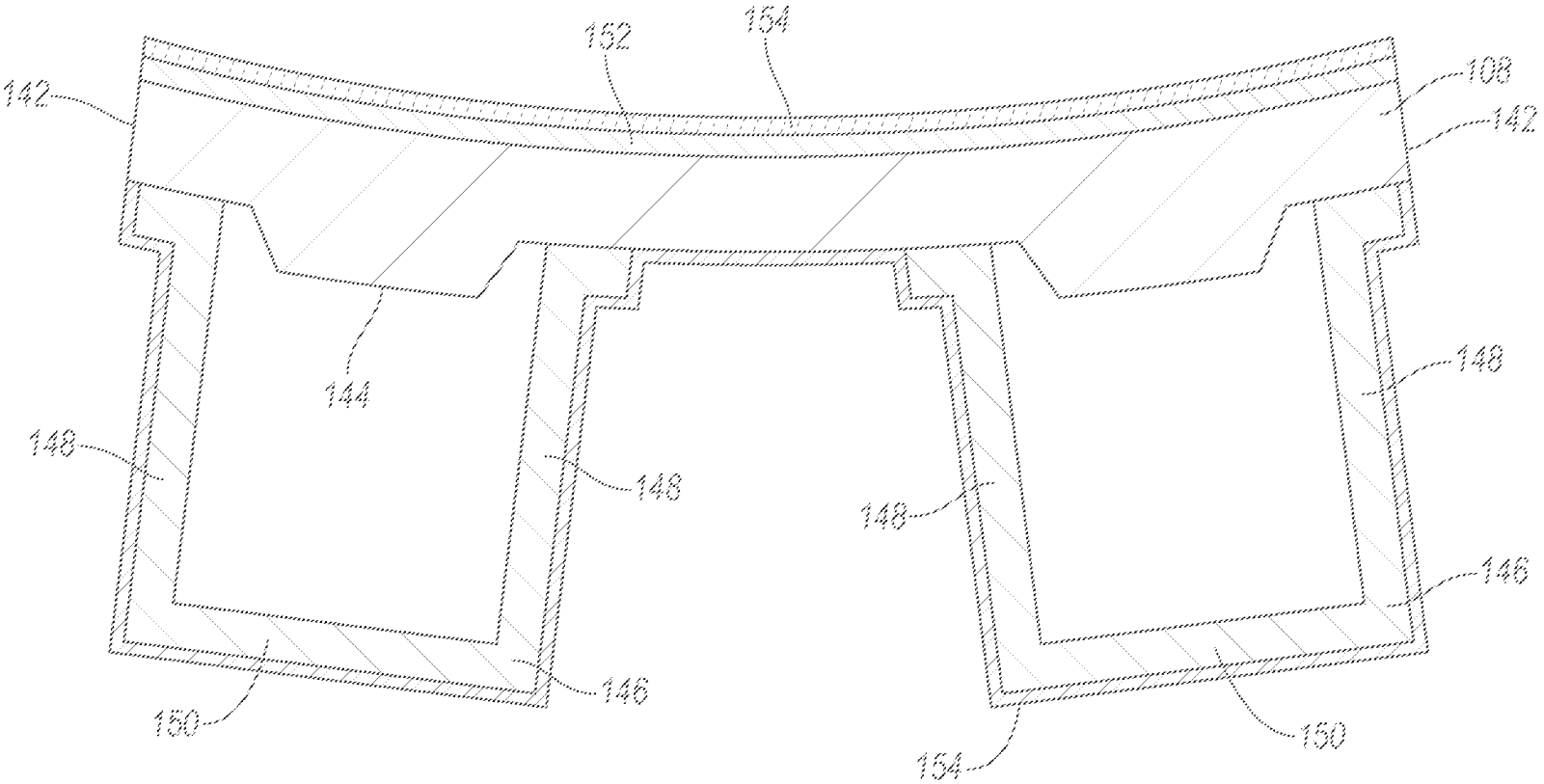
FIG. 7 is a cross-sectional view of the panel and braces.

With reference to FIGS. 6 and 7, each brace 146 can include two side walls 148 extending away from the respective panel 108 and a cross wall 150 extending between the two side walls 148, i.e., from one of the side walls 148 to the other of the side walls 148. Each brace 146 is attached to the respective panel 108 at the side walls 148, specifically an edge of each side wall 148 is affixed to the convex side of the respective panel 108. Each side wall 148 can extend axially relative to the antenna axis from the respective panel 108 to the respective cross wall 150. Each cross wall 150 is spaced from the respective panel 108. Each cross wall 150 is angled away from the respective panel 108 in a direction from the outer circumferential edge 140 toward the inner circumferential edge 138, i.e., in a radially inward direction relative to the antenna axis; in other words, the closer radially to the antenna axis, the farther the cross wall 150 is from the respective panel 108. This shape of the brace 146 efficiently supports the respective panel 108 to help prevent deflection of the respective panel 108.

Each panel 108 can include at least one rib 144 extending from the outer circumferential edge 140 toward the inner circumferential edge 138. The ribs 144 can be positioned on the convex sides of the respective panels 108. For example, each panel 108 can include two ribs 144, and each rib 144 can be positioned within a respective one of the braces 146. Each rib 144 can be positioned between the side walls 148 of the respective brace 146. Each rib 144 can be elongated following a same path as the respective brace 146. The ribs 144 can increase a stiffness of the panel 108 and can help position the respective braces 146 during assembly.

With reference to FIG. 7, the panels 108 and the braces 146 can be carbon fiber-reinforced polymer. Carbon fiber-reinforced polymers include carbon fibers set within and reinforcing a binding polymer. Carbon fiber-reinforced polymers can give the parabolic dish 110 a high structural rigidity to help maintain the paraboloid shape of the parabolic dish 110 even in high winds. Carbon fiber-reinforced polymer can provide sufficient stiffness while making the antenna 106 lightweight. A lightweight antenna 106 can be easier for the actuator assembly 122 to aim. Moreover, carbon fiber-reinforced polymers have a low coefficient of thermal expansion, which can also help maintain the paraboloid shape of the parabolic dish 110 despite temperature fluctuations. The polymer of the braces 146 can be bonded to the polymer of the respective panels 108, i.e., fused together. The antenna 106 can lack fasteners attaching the braces 146 to the respective panels 108.

The antenna 106 can include an electrically conductive mesh 152 affixed to a concave side of the parabolic dish 110. The mesh 152 can reflect incoming radio waves to the feed antenna 132 or can direct radio waves emitted by the feed antenna 132. The mesh 152 can be, e.g., copper. The mesh 152 can conform to a paraboloid shape defined by the parabolic dish 110. The mesh 152 can extend circumferentially fully around the antenna feed and can extend radially from the antenna feed to the outer diameter of the parabolic dish 110.

The antenna structure 120 can include paint 154 covering the pedestal 102, the hub 104, and the antenna 106. For example, the paint 154 can cover the mesh 152 and the parabolic dish 110, e.g., the paint 154 can be applied to the mesh 152, the braces 146, and the portions of the panels 108 exposed by the braces 146 and the mesh 152. The paint 154 can protect the antenna structure 120 from environmental elements. The paint 154 can be white to reduce heat absorbed by the antenna structure 120.

The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A satellite-communications gateway comprising:

a hub;

an antenna configured for satellite communications, the antenna being mounted to the hub and supported by the hub; and a plurality of braces;

wherein the antenna includes a plurality of panels forming a parabolic dish;

the number of the braces is at least twice the number of the panels;

the panels and the braces are carbon fiber-reinforced polymer;

the parabolic dish has a diameter in a range of 9 to 13 meters;

the braces are attached on a convex side of the parabolic dish;

each panel includes an inner circumferential edge, an outer circumferential edge, and two radial edges extending between the circumferential edges;

for each panel, at least two of the braces are elongated along the respective two radial edges from the outer circumferential edge toward the inner circumferential edge; and each panel includes at least two ribs extending from the outer circumferential edge toward the inner circumferential edge, each rib being positioned within a respective one of the braces.

2. The satellite-communications gateway of claim 1, further comprising an electrically conductive mesh affixed to a concave side of the parabolic dish.

3. The satellite-communications gateway of claim 2, wherein the mesh conforms to a paraboloid shape defined by the parabolic dish.

4. The satellite-communications gateway of claim 2, further comprising paint covering the mesh and the parabolic dish.

5. The satellite-communications gateway of claim 1, wherein the braces are elongated in respective radial directions relative to the parabolic dish.

6. The satellite-communications gateway of claim 5, wherein each brace is elongated in the respective radial direction from the hub to an outer diameter of the parabolic dish.

7. The satellite-communications gateway of claim 1, wherein each brace includes two side walls extending away from the respective panel and a cross wall extending between the side walls, the brace being attached to the respective panel at the side walls, and the cross wall being spaced from the respective panel.

8. The satellite-communications gateway of claim 7, wherein each cross wall is angled away from the respective panel in a direction from the outer circumferential edge toward the inner circumferential edge.

9. The satellite-communications gateway of claim 1, wherein the panels include twelve identical panels.

10. The satellite-communications gateway of claim 1, wherein the panels are arranged in a single series circumferentially about the hub.

11. The satellite-communications gateway of claim 1, wherein the antenna includes a secondary reflector in a Cassegrain configuration with the parabolic dish.

12. The satellite-communications gateway of claim 1, further comprising a pedestal, and an actuator assembly movably coupling the hub to the pedestal.

13. The satellite-communications gateway of claim 12, wherein the actuator assembly has two rotational degrees of freedom.

14. The satellite-communications gateway of claim 12, wherein the pedestal defines a vertical axis, and the actuator assembly includes an azimuth bearing assembly that is actuatable to rotate the hub and the antenna about the axis relative to the pedestal.

15. The satellite-communications gateway of claim 12, wherein the actuator assembly includes an elevation jack that is actuatable to tilt the hub and the antenna about a horizontal axis relative to the pedestal.

16. The satellite-communications gateway of claim 15, wherein the actuator assembly includes an azimuth bearing assembly, the elevation jack is mounted to the azimuth bearing assembly, and the azimuth bearing assembly is actuatable to rotate the hub, the antenna, and the elevation jack about the axis relative to the pedestal.

17. The satellite-communications gateway of claim 12, wherein the pedestal is fixedly mounted to the ground.

* * * * *